US008643311B2

(12) United States Patent
Nevins

(10) Patent No.: US 8,643,311 B2
(45) Date of Patent: Feb. 4, 2014

(54) DAYLIGHT TRACKING SIMULATOR AND/OR PHOTOTHERAPY DEVICE

(76) Inventor: Michael Olen Nevins, Jackson, MI (US)

( * ) Notice: Subject to any disclaimer, the term of this patent is extended or adjusted under 35 U.S.C. 154(b) by 739 days.

(21) Appl. No.: 12/274,322

(22) Filed: Nov. 19, 2008

(65) Prior Publication Data

US 2009/0128044 A1 May 21, 2009

Related U.S. Application Data

(60) Provisional application No. 61/003,604, filed on Nov. 19, 2007.

(51) Int. Cl.
*H05B 37/02* (2006.01)

(52) U.S. Cl.
USPC ..... 315/313; 315/363; 315/362; 315/294; 315/297

(58) Field of Classification Search
USPC ..... 315/291, 77, 297, 307, 294, 360
See application file for complete search history.

(56) References Cited

U.S. PATENT DOCUMENTS

2001/0028227 A1* 10/2001 Lys et al. ..... 315/317
2002/0101197 A1* 8/2002 Lys et al. ..... 315/291
2002/0113555 A1* 8/2002 Lys et al. ..... 315/149
2003/0057886 A1* 3/2003 Lys et al. ..... 315/291
2003/0222587 A1* 12/2003 Dowling et al. ..... 315/149
2005/0122718 A1* 6/2005 Kazar et al. ..... 362/252
2005/0242742 A1* 11/2005 Cheang et al. ..... 315/149
2006/0235493 A1* 10/2006 Dotson ..... 607/89
2008/0018261 A1* 1/2008 Kastner ..... 315/192
2008/0151537 A1* 6/2008 Robertson ..... 362/228
2008/0278100 A1* 11/2008 Hwang ..... 315/360

FOREIGN PATENT DOCUMENTS

KR 10-2008-0000927 * 1/2008

* cited by examiner

*Primary Examiner* — Douglas W Owens
*Assistant Examiner* — Jonathan Cooper
(74) *Attorney, Agent, or Firm* — Lowe Hauptman & Ham, LLP

(57) ABSTRACT

A fluorescent or light emitting diode-based system for generating light flux. The system comprises a lamp comprising at least one light source for illuminating an area. At least one of the at least one light source is selected from the group comprising at least one of a fluorescent light source or an LED light source. The lamp also comprises a light source controller electrically coupled with the light source and arranged to control the spectral output of the light source. The lamp also comprises a power supply and a switch electrically coupled between the lamp and the power supply and arranged to control the supply of power from the power supply to the lamp.

7 Claims, 10 Drawing Sheets

DAYLIGHT TRACKING SIMULATOR AND/OR PHOTOTHERAPY DEVICE

RELATED APPLICATIONS

The present application is related and hereby claims priority to prior provisional application entitled, "LED/fluorescent daylight tracking simulator and phototherapy device" having application Ser. No. 61/003,604 filed on Nov. 19, 2007 and is hereby incorporated herein by reference in its entirety.

BACKGROUND

An example of an organ whose regulatory function is responsive to light sensed by the eyes is the pineal gland which secretes the hormone melatonin. The hormone is released during periods of darkness while production is abruptly halted when the eyes perceive bright light. Melatonin is distributed throughout the body via blood and cerebrospinal fluid and can effect the function of organs by which it is metabolized to thereby influence sleep cycles, feeding cycles, reproduction cycles and other biological rhythms. It has therefore been suggested that phototherapy may effectively be employed to correct a melatonin imbalance which may have resulted from, for example, shift work, jet lag or life in the Polar Regions, and thereby remedy the accompanying symptoms.

Millions of North Americans feel the effects of malillumination which causes poor work conditions and can result in less energy and productiveness. Poor lighting environments can cause increased depression and even result in more severe cases called Seasonal Affective Disorder (SAD). This problem increases more and more as the winter months bring shorter and shorter days. Sunlight starvation also effects millions more in the form of a milder form called Winter Blues.

Simulated full spectrum light is color corrected light that operates in the range of 400 to 800 nanometers. This light simulates the optical brilliance of outdoor light at noontime. This light can be measured by two numbers, the Color Rendering Index (CRI) and the Kelvin Temperature or (Degrees Kelvin). The secret to true color light and optically balanced light is how close you can get to the optics of natural light. The sun at noon has a natural color temperature of 100 CRI and between 5000 and 5500 degrees Kelvin. Both CRI and Kelvin are important for the simulation sunlight.

When light is simulated that matches the optical brilliance of sunlight pupils in one's eyes become smaller. This response generates clearer vision and higher perception. The results are lower glare and eye fatigue. When Lux intensity is combined with high CRI and balanced Kelvin temperature, quality light is obtained that not only matches the optical brilliance of the sun, but reduces levels of melatonin and the stress hormone, cortisol. Full spectrum light is not blue light or daylight color. It is clear, brilliant, white light and simulates the exact color of sunlight at noon. Many people currently progress through life missing sunlight because of the enormous amounts of time that are spent indoors.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
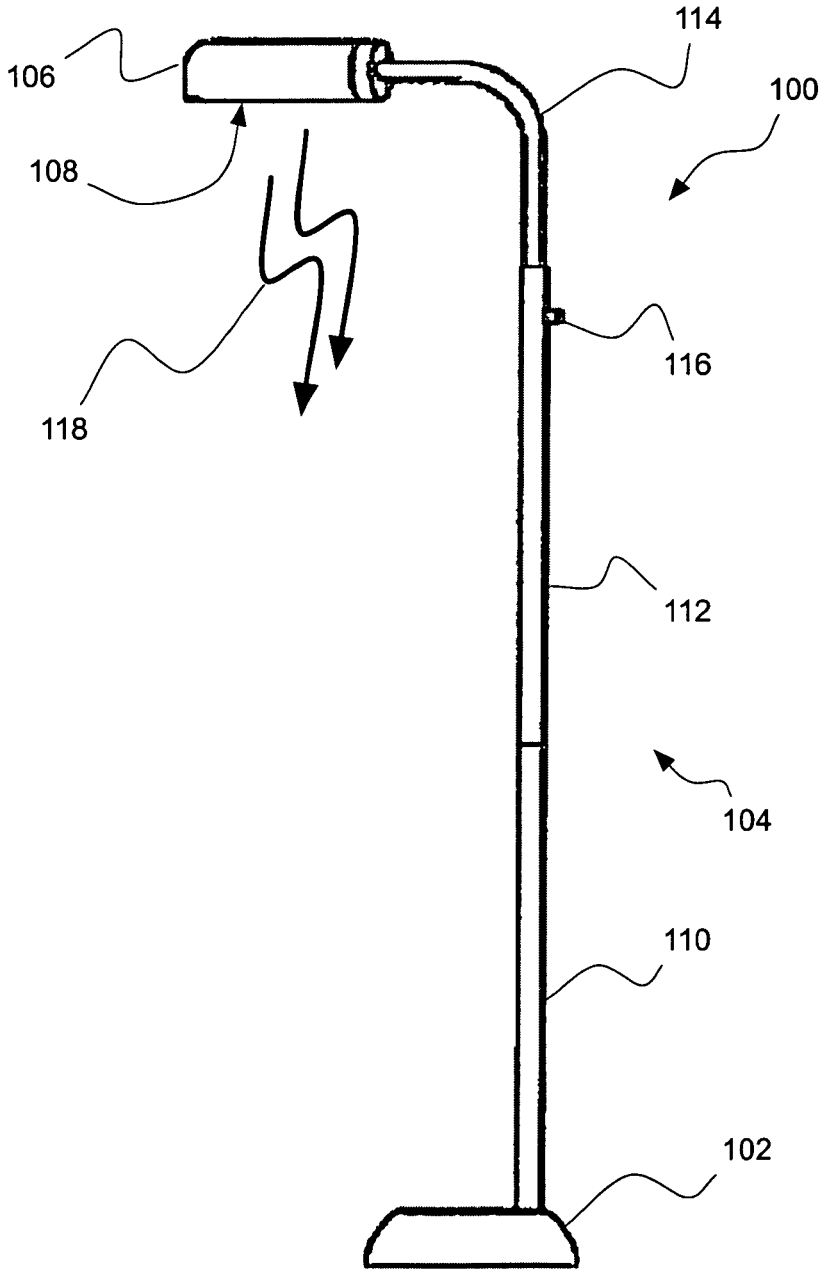
FIG. 1 is a side view of a lamp according to an embodiment.

FIG. 1 depicts a freestanding lighting system 100 arranged to provide phototherapy and/or daylight tracking simulation according to one or more embodiments. Freestanding lighting system 100 may be placed on a floor surface and comprises a base support 102 which provides a stable support platform for the lighting system, a vertically extending connection member 104, a light source holder 106, and a light source 108. Light source 108 is configured to generate a photo-therapeutic flux (or luminance) from a florescent or LED-based light source. Lighting system 100 is arranged to selectively provide color changes as well as luminance intensity changes, i.e. locks intensity changes, based on a time schedule or specific phototherapy setting through the use of digital or analog controls, and/or computer programming or other control devices.

Vertically extending connection member 104 is cooperatively coupled with light source holder 106 at one and is cooperatively coupled with a support 102 at a distal end thereof. Connection member 104, as depicted in FIG. 1, comprises a first segment 110 connected at one end to base support 102, a second segment 112 connected to the first segment, and the third segment 114 connected at one end to the second segment and at the other end to light source holder 106. As depicted, third segment 114 comprises a curvilinear portion to change the direction of the segment from substantially vertical to horizontal.

Second segment 112 comprises a switch 116 for controlling operation of lighting system 100. In at least some embodiments, switch 116 may be positioned in another segment of the connection member 104, as part of base support 102, as part of light source holder 106, or remotely located from lighting system 100.

Light source 108 is positioned within light source folder 106 and, in operation, generates illumination (generally indicated by arrows identified by reference numeral 118). Light source 108 comprises a light-generating mechanism selected from at least one of a fluorescent lamp or a light emitting diode (LED) lamp. In at least some embodiments, light source 108 may comprise more than one lamp or light-generating mechanism. In at least some embodiments, light source 108 comprises either a fluorescent lamp or an LED lamp exclusive of another type of lamp, e.g., incandescent lamp or light source.

In at least some embodiments, one or more of a support 102 connection member 104, or light source holder 106 may be comprised of a metallic material. In at least some embodiments, the third segment 114 may comprise at least a portion of a flexible material enabling bending of light source holder with respect to the vertical extension of connection member 104.

In at least some embodiments, switch 116 is electrically coupled with light source 108 via wiring extending within or along third segment 114 of connection number 104. In at least some embodiments, lighting system 100 comprises an integrated power supply, e.g., a battery, or is configured to receive power from a power supply source, e.g., line or mains power.

Figure 2:
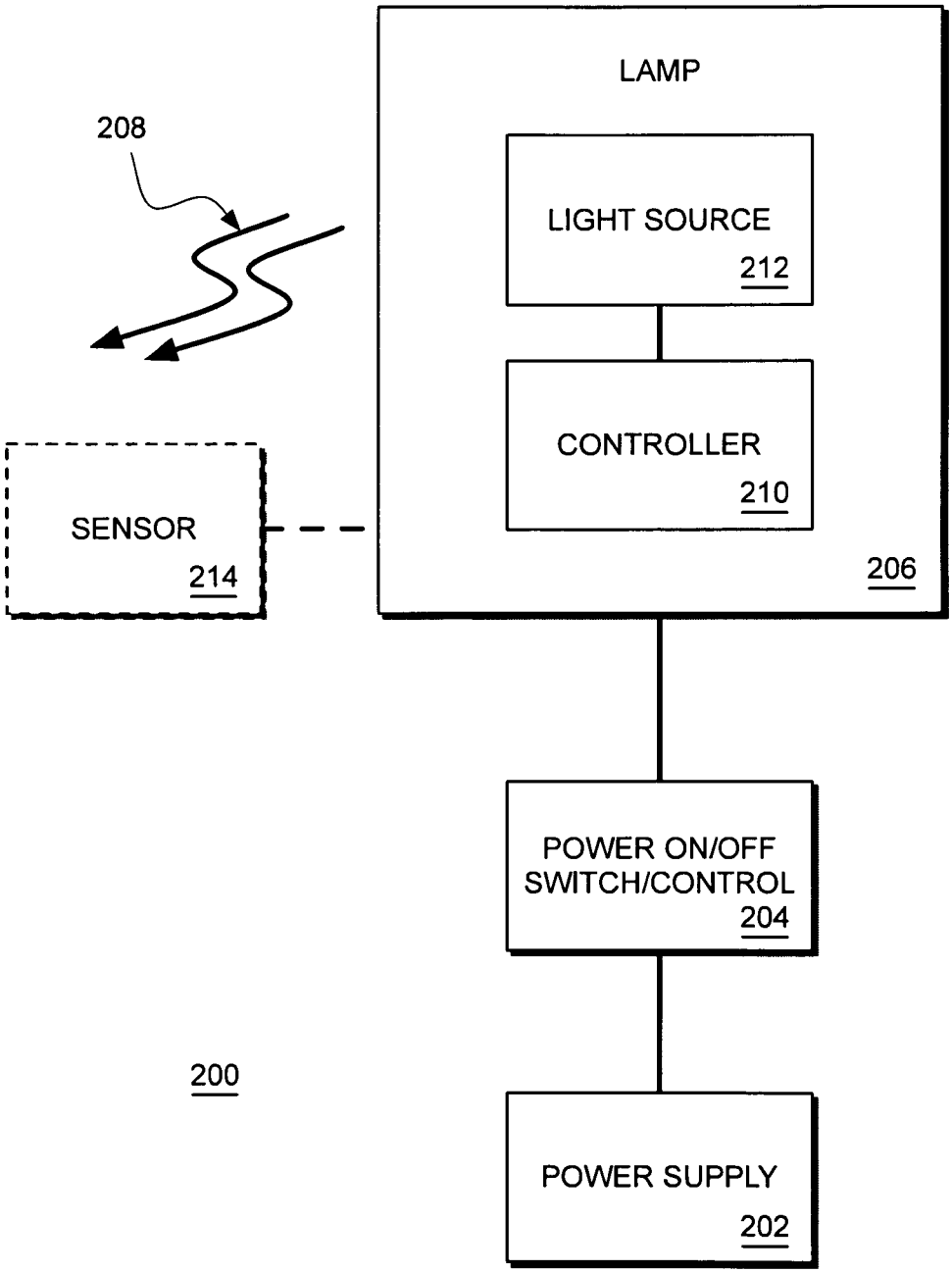
FIG. 2 is a high level functional block diagram of a lamp according to an embodiment.

FIG. 2 depicts a high-level functional block diagram of a lighting system 200 (similar to lighting system 100 (FIG. 1)) according to an embodiment. Lighting system 200 comprises a power supply 202, which in some embodiments may alternatively be a power source, electrically coupled with a power on/off switch/control 204 for controlling the transmission of electrical power from power supply 202 to a lamp 206.

In at least some embodiments, switch/control 204 may be a switch, e.g., switch 116 (FIG. 1). Switch/control 204 may be configured in the form of an appropriate switch device for turning the lamp 206 on and off. For example, switch/control 204 may be a knob or dial rotatable in one direction to turn the lamp on, e.g. clockwise, and rotatable in the other direction to turn the lamp off, e.g. counterclockwise.

Switch/control 204 may alternatively be configured as a one and/or two push button control and may be used alternately or simultaneously. One push button operation may be effected by configuring switch/control 204 with one button, and pressing switch/control 204 button briefly, e.g., below a predetermined period of time, to switch the lamp 206 on or off. By pressing switch/control 204 button longer, e.g., above the predetermined period of time, the lamp 206 generates illumination 208 according to a different spectral output, e.g., warmer or cooler color output. The last spectral output may be stored in the lamp 206 when the lamp is switched off, and may be retrieved when the lamp is switched on.

In at least some embodiments, lamp 206 may be a light source holder, e.g., light source holder 106 (FIG. 1). Lamp 206 is electrically coupled with switch/control 204.

Lamp 206 comprises a light source controller 210 cooperatively coupled with a light source 212. In at least some embodiments, light source 212 is either a fluorescent light source or a light emitting diode (LED) light source. In at least some embodiments, light source 212 comprises at least two light sources where one of the light sources is a fluorescent light source and the other is an LED light source. In at least some other embodiments, light source 212 comprises at least one incandescent light source and at least one light source selected from a group comprising at least a fluorescent light source or an LED light source.

Light source controller 210 is arranged to control the spectrum output of light source 212. In at least some embodiments in which light source 212 comprises more than a single light source, light source controller 210 is arranged to control each light source individually or according to one or more groupings of light sources.

According to a multi-light source embodiment, light source 212 comprises a heterogeneous set of light sources in which each light source has a different color temperature output. For example, a first light source may have a correlated color temperature (CCT) of 8,000 Kelvin (K) whereas a second light source may have a CCT of 3,000 K. In accordance with such a heterogeneous multi-light source embodiment, controller 210 is arranged to vary the spectrum output of the combined light sources as light source 212 by varying the brightness of the individual light sources. For example, in order to achieve a first spectrum output level, controller 210 may cause the first light source brightness level to be set to output at 50% of the maximum output level of the light source and cause the second light source brightness level to be set to output at 75% of the maximum output level of the light source resulting in a spectrum output of light source 212 tending more toward the second light source color temperature, i.e., 3,000K. That is, a blending of the spectrum output of the individual light sources may be generated.

In at least some embodiments, different numbers of light sources and different combinations of light sources having specific color temperature output may be combined to form light source 212. In at least one embodiment, a set of three heterogeneous light sources may be used in which a first light source color temperature is 10,000 K, a second light source color temperature is 3,500 K, and a third light source color temperature is 5,000 K. Varying the brightness of the individual light sources enables lamp 206 to output different spectrum output illumination.

In at least some embodiments, light source controller 210 adjusts the brightness of the individual light sources comprising light source 212 in order to obtain a particular spectrum output. The particular spectrum output by light source 212 may be monitored through the use of sensor 214. In at least some embodiments, a user may cause light source controller 210 to vary the spectrum output by manipulating switch/control 204. In at least some further embodiments, light source controller 210 is arranged to apply a particular percentage allocation to each of the light sources while varying the illumination intensity of the light sources at a constant level.

In at least some embodiments, a phosphor blend using multiple bands, e.g., from four to ten bands, is used in the light source to produce a desired blend that produces a balanced spectrum, as well as operate near the 580 nm peak of the scotopic curve.

In at least some embodiments, controller 210 is a discrete integrated circuit or set of integrated circuits configured to control light source 212 according to an embodiment. In at least some other embodiments, controller 210 is a processor or application specific integrated circuit (ASIC) configured to control light source 212 according to an embodiment.

In at least some embodiments, lighting system 200 also comprises a sensor 214 such as a light sensor configured to detect a frequency of the illumination 208 generated by light source 212. For example, sensor 214 may comprise a sensor to detect the spectral output of light source 212. In at least some other embodiments, sensor 214 is a position determination system such as a global positioning satellite (GPS) system receiver arranged to determine one or both of a geographic location of lighting system 200 or a current date and/or time.

Figure 3:
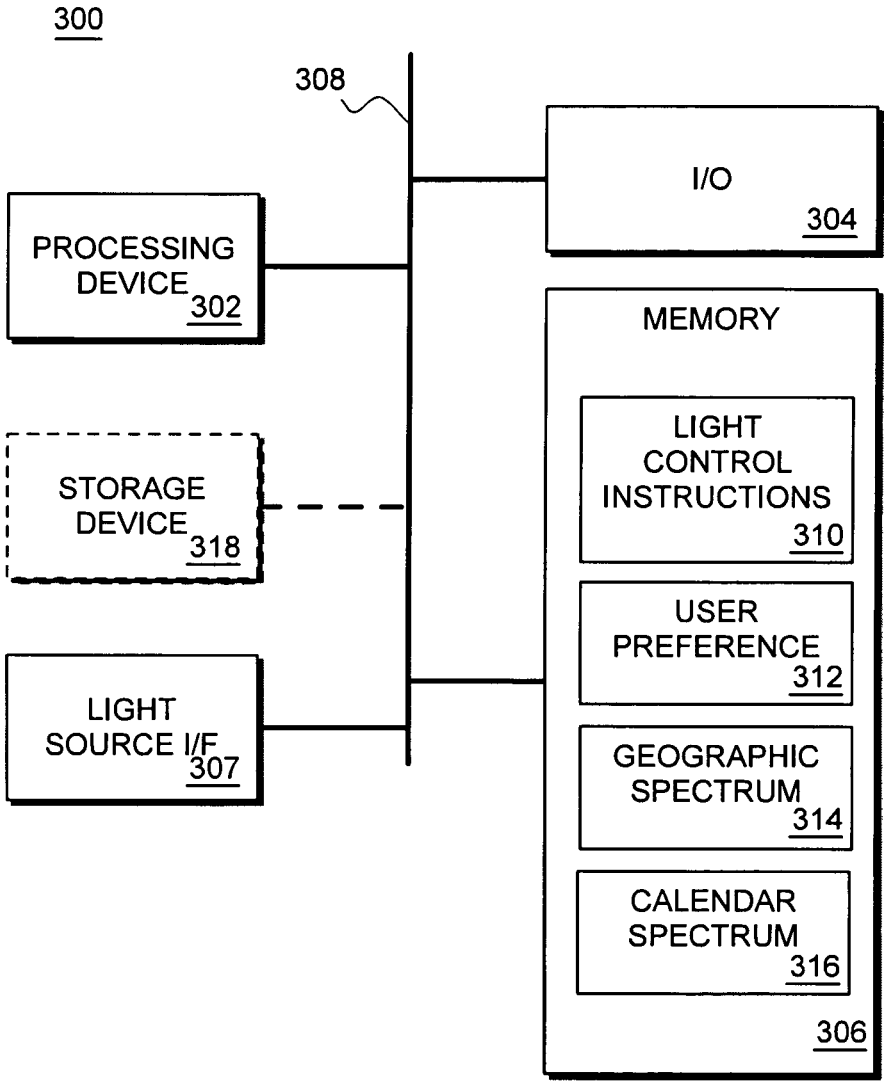
FIG. 3 is a high-level functional block diagram of a controller according to an embodiment.

FIG. 3 depicts a high-level functional block diagram of a controller 300 according to an embodiment in conjunction with which an embodiment of the present invention may be executed to great advantage. Controller 300 comprises a processing device 302 (alternatively referred to as a processor), an input/output (I/O) device 304, a memory 306, and a light source interface (I/F) device 307 each communicatively coupled via a bus 308 or other interconnection communication mechanism.

In at least some embodiments, processing device 302 may be a controller and/or and application-specific integrated circuit (ASIC) configured to execute a set of instructions such as those embodied by an embodiment.

Memory 306 (also referred to as a computer-readable medium) may comprise a random access memory (RAM) or other dynamic storage device, coupled to the bus 308 for storing data and/or instructions to be executed by processing device 302, e.g., light control instructions 310, user preference(s) 312, geographic spectrum setting 314, or calendar spectrum setting 316. Memory 306 also may be used for storing temporary variables or other intermediate information during execution of instructions to be executed by processing device 302. Memory 306 may also comprise a read only memory (ROM) or other static storage device coupled to the bus 308 for storing static information and instructions for the processing device 302.

A storage device (optional dashed line box 318), such as a magnetic, optical, electromagnetic, or holographic disk or other storage medium, may also be provided and coupled to the bus 308 for storing data and/or instructions.

In at least some embodiments, light control instructions 310 comprise a set of executable instructions which, when executed by processing device 302, cause the processing device to control a light source, e.g., light source 212 (FIG. 2).

I/O device 304 may comprise an input device, an output device and/or a combined input/output device for enabling user interaction. An input device may comprise, for example, a keyboard, keypad, mouse, trackball, trackpad, and/or cursor direction keys for communicating information and commands to processing device 302. An output device may comprise, for example, a display, a printer, a voice synthesizer, etc. for communicating information to a user. In at least some embodiments, I/O device 304 may comprise a serial and/or parallel connection mechanism for enabling the transfer of one or more of files and/or commands, e.g., an Ethernet or other type network connection.

In at least some embodiments, I/O device 304 is cooperatively coupled with sensor 214 in order to receive a signal representative of a spectral output of light source 307. In at least some embodiments, I/O device 304 is cooperatively coupled with sensor 214 in order to receive a geographic location or a current date and/or time.

Light source I/F 307 comprises an electrical, optical, and/or electro-optical interface between controller 210 and light source 212 (FIG. 2). Light source I/F 307 connects controller 300 to a light source, e.g., light source 212, and enables the controller to control the illumination output of the light source. For example, controller 300 via light source I/F 307 is able to turn on and off the light source and/or modify the spectral output characteristics of the light source responsive to execution of light control instructions 310.

Figure 4:
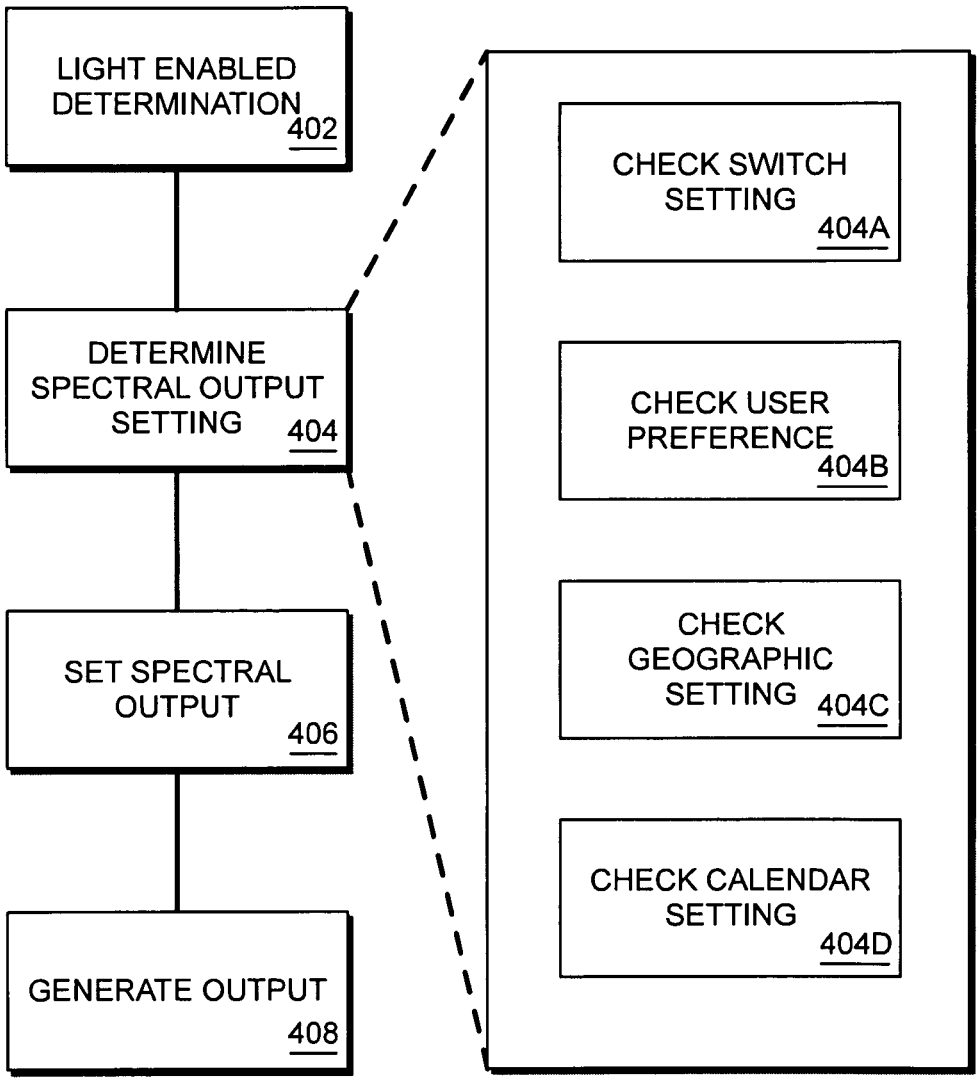
FIG. 4 is a high level process flow diagram of a light controller usable in conjunction with an embodiment.

FIG. 4 depicts a high-level process flow diagram of at least a portion 400 of a method, e.g., execution of light control instructions 310 (FIG. 3) by processing device 302, according to an embodiment. The process flow begins at light enable determination functionality 402 wherein execution of light control instructions 310 by processing device 302 causes controller 300 to determine whether lighting system 200, e.g., via receipt of input from switch/control 204 (FIG. 2) or via another input device connected to I/O device 304, is turned on. In at least some embodiments, light enabled determination 402 may be eliminated and the receipt of power from power supply 202 (FIG. 2), either with or without switch/control 204 as appropriate, provides the functionality.

The flow then proceeds to determine spectral output setting functionality 404. During execution of functionality 404, lighting system 200 determines the spectral output frequency to be generated by light source 212 (FIG. 2). The determination may comprise one or more of reading a value from a memory location, e.g., user preference 312 of memory 306 (FIG. 3), or reading the position of switch/control 204.

In at least some embodiments, one or more of additional functionalities, i.e., check switch setting 404A, check user preference 404B, check geographic setting 404C, or check calendar setting 404D, may be executed in order to determine the spectral output setting.

Check switch setting functionality 404A causes processing device 302 to determine the position of switch/control 204 or another switch/control attached to lighting system 200 in order to determine the spectral output frequency desired.

Check user preference functionality 404B causes processing device 302 to read the value stored in user preference 312 of memory 306 (FIG. 3) in order to determine the spectral output frequency desired.

Check geographic setting functionality 404C causes processing device 302 to read the value stored in geographic spectrum setting 314 of memory 306 (FIG. 3) in order to determine the spectral output frequency desired. In at least some embodiments, geographic spectrum setting 314 may specify a particular spectrum output for each of one or more geographic locations, i.e., a different spectrum output may be specified for a different location. In at least some embodiments, check geographic setting functionality 404C may compare a stored geographic location with a determined current geographic location to determine whether the spectrum setting should be used. For example, the current geographic location may be determined with reference to an internal position-determining mechanism, a user-supplied geographic location, or via a geographic location determined by an external device such as sensor 214, e.g., a GPS-type or broadcast signal such as LORAN.

Check calendar setting functionality 404D causes processing device 302 to read the value stored in calendar spectrum setting 316 of memory 306 (FIG. 3) in order to determine the spectral output frequency desired. Calendar spectrum setting 316, in some embodiments, may further specify a period of time (either date or time of day) during which a particular spectrum setting is valid. In at least some embodiments, calendar spectrum setting 316 may specify a particular spectrum output for each of one or more portions of a day, i.e., a different spectrum output may be specified for a different period of a given day. In at least some embodiments, check calendar setting functionality 404D may compare a stored date value with a determined current date to determine whether the spectrum setting should be used. For example, the current date or time may be determined with reference to an internal clock or timer, a user-supplied date or time, or via a date or time determined by an external device such as sensor 214, e.g., a GPS-type or broadcast atomic signal.

In at least some embodiments, user preference 312 also stores priority information specifying which particular setting, if more than one are present, takes priority over the other settings. For example, user preference 312 may indicate that if the date meets a predetermined threshold value, then the switch/control 204 may be used as the preferred spectral output setting. On the other hand, if the geographic location of the lighting system 200 is within a predetermined distance of the geographic setting, then the calendar spectrum setting 314 may be used as the preferred spectral output setting.

After determining the spectral output setting to be used, the flow proceeds to set spectral output functionality 406 wherein execution of the instructions causes processing device 302 to transmit the determined spectral output setting to light source I/F 307. The flow then proceeds to generate output functionality 408 wherein processing device 302 causes light source I/F 307 to cause light source 212 to generate illumination having the determined spectrum setting.

In at least some embodiments, functionality 406 and 408 may be combined into a single functionality performing the transmission of the spectrum output setting and activation of light source 212.

Figure 5:
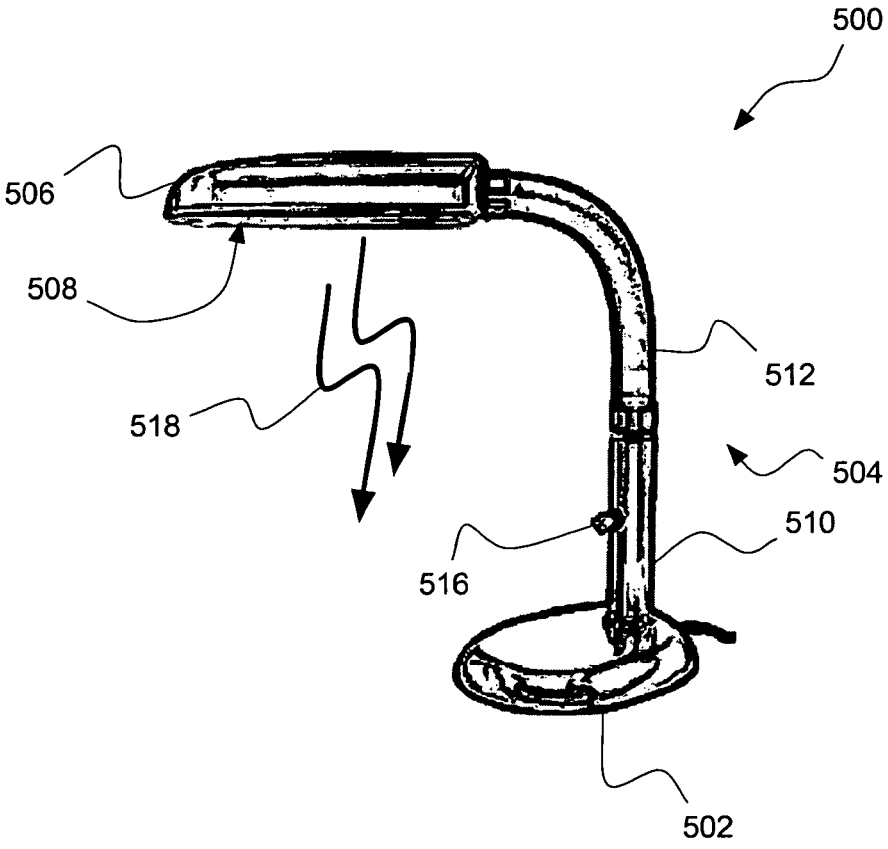
FIG. 5 is a side view of a lamp according to another embodiment.

FIG. 5 depicts a side view of a lamp 500 according to another embodiment for a desk or task-based lamp. Similar to lamp 100, lamp 500 comprises a base support 502, a vertically extending connection member 505, a light source holder 506, and a light source 508. Connection member 505 comprises a segment 510 extending generally vertically and connected with a curved segment 512 forming an angle enabling illumination of a surface below lamp 500. Lamp 500 also comprises a switch/control 516 similar to switch/control 204 (FIG. 2). In operation, light source 508 generates and transmits illumination 518. Lamp 500 comprises a light control system similar to the light control system 300 (FIG. 3).

In at least some embodiments, curved segment 512 of lamp 500 is flexible enabling a user to modify the amount of curvature of the segment.

Figure 6:
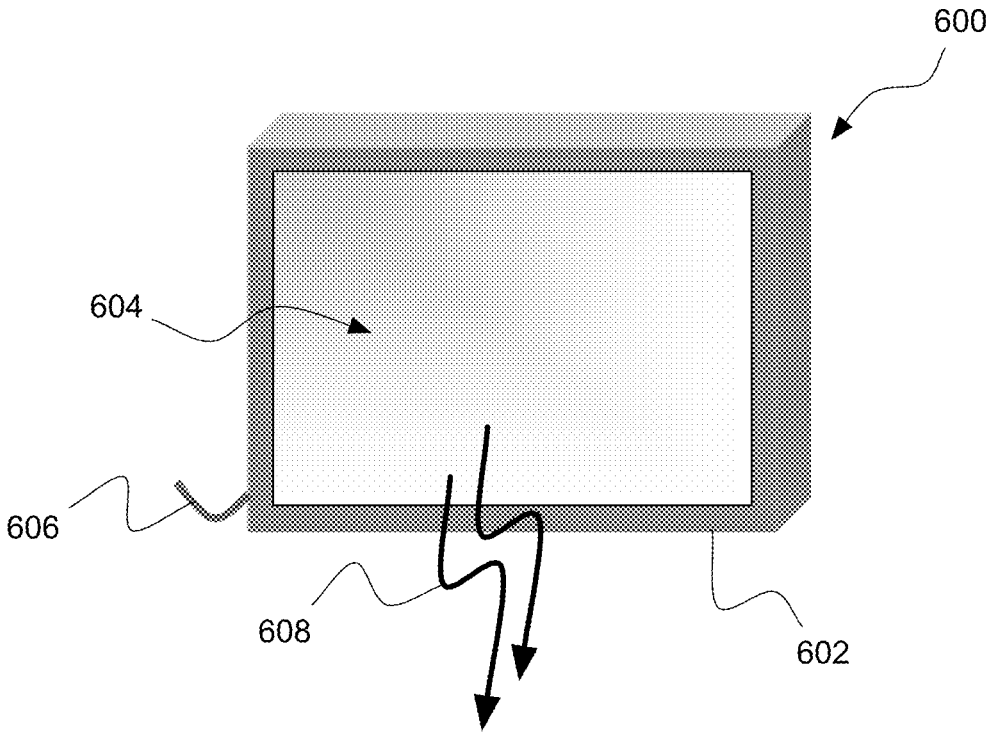
FIG. 6 is a perspective view of a light box according to an embodiment.

FIG. 6 depicts a perspective view of a light box 600 according to an embodiment. Light box 600 comprises a generally parallelepiped box 602 having a relatively large front face in comparison to the sides, top, and bottom. In at least some embodiments, box 602 may be different shapes and sizes without departing from the spirit and scope of the present embodiments.

The front face of box 602 comprises a light source holder 604. Light source holder 604 comprises a light source similar to light source 212 (FIG. 2). Box 600 comprises a power cord 606 for connecting the box to a power supply. In at least some embodiments, box 600 excludes the power cord 606 and relies on a stored power source such as a battery to power the box and the illumination 608 generation.

In operation, light source holder 604 generates and transmits illumination 608. Lamp 600 comprises a light control system similar to the light control system 300 (FIG. 3).

Figure 7:
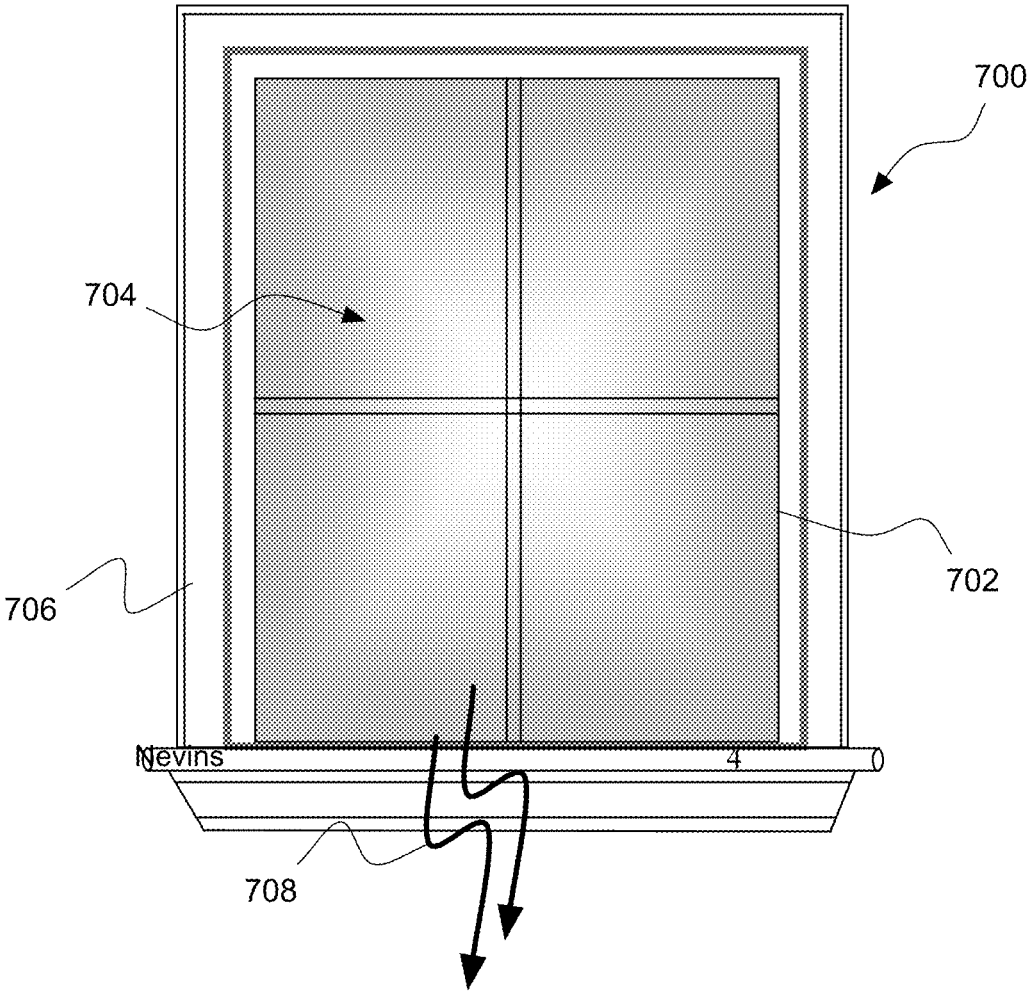
FIG. 7 is a front view of a light window according to an embodiment.

FIG. 7 depicts a front view of a light window 700 according to an embodiment. In operation, light window 700 may be used in place of or in addition to a nominal window allowing light to pass through. Light window 700 comprises a generally rectangular panel 702 comprising a light source holder 704. Light source holder 704 comprises a light source similar to light source 212 (FIG. 2).

Light window 700 also comprises a window frame 706 configured to replicate a normal window frame in use. In at least some embodiments, window frame 706 may be used to mount light window 700 on a wall or other vertical surface. In at least some other embodiments, window frame 706 may be a different size, shape, and/or configuration as appropriate for a particular location. For example, window frame 706 may be square, elliptical, circular, or otherwise shaped.

In operation, light source holder 704 generates and transmits illumination 708. Light window 700 comprises a light control system similar to the light control system 300 (FIG. 3).

Figure 8:
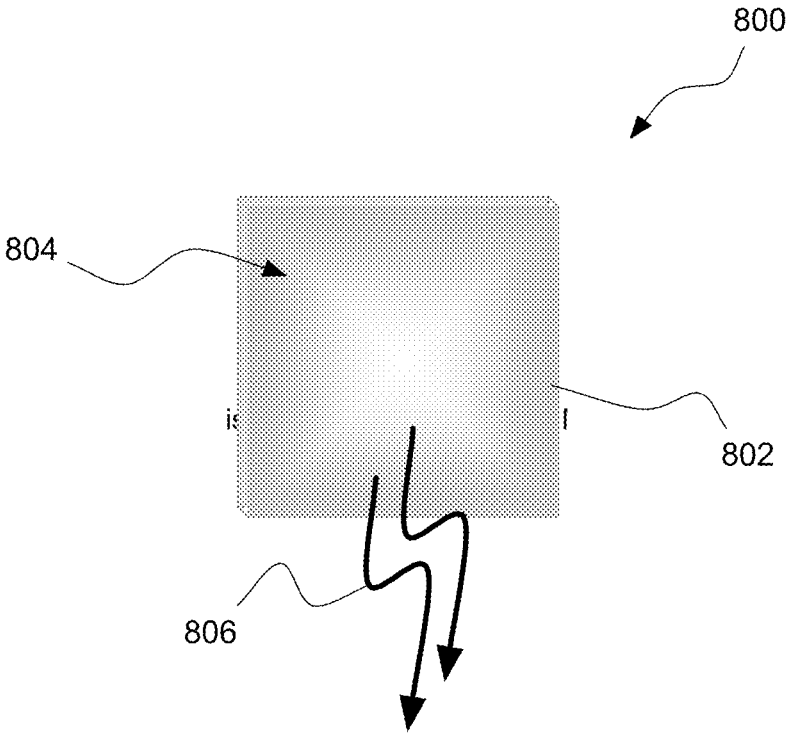
FIG. 8 is a perspective view of a light tile according to an embodiment.

FIG. 8 depicts a perspective view of a light tile 800 according to an embodiment. In operation, light tile 800 may be used in place of or in addition to a nominal tile, e.g., as used in a home or office setting. Light tile 800 comprises a generally rectangular panel 802 comprising a light source holder 804. Light source holder 804 comprises a light source similar to light source 212 (FIG. 2).

In at least some other embodiments, light tile 800 may be different shapes and sizes without departing from the spirit and scope of the present embodiments. In at least one embodiment, light tile 800 is sized to fit within a user's briefcase and be transportable by a user. For example, in some embodiments, the light tile may be six, eight, ten, or at least twelve inches along at least one dimension.

In operation, light source holder 804 generates and transmits illumination 806. Light tile 800 comprises a light control system similar to the light control system 300 (FIG. 3). Light tile 800 may comprise a battery or other power source enabling the tile to be self-sufficient power-wise for a time period.

Figure 9:
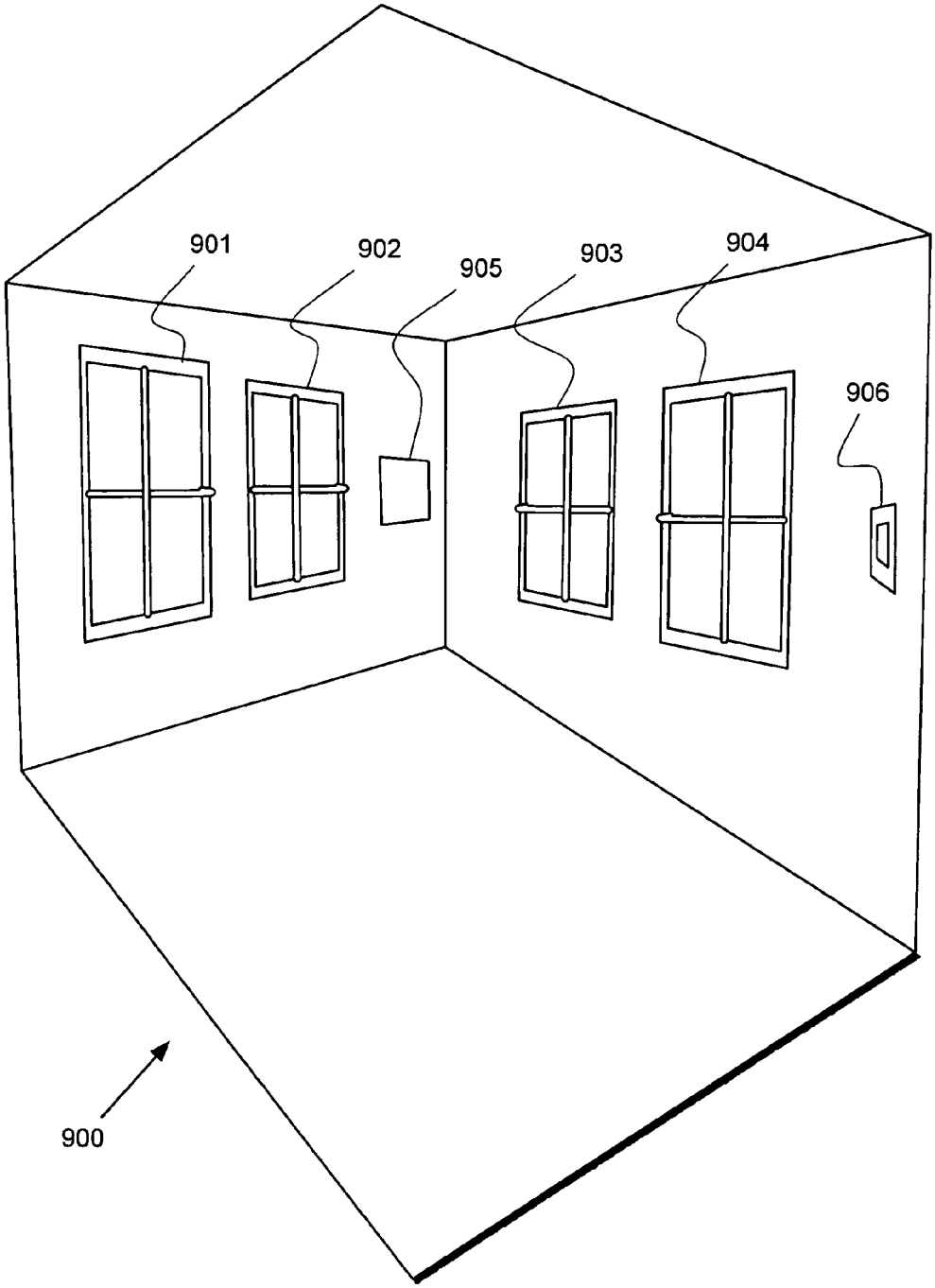
FIG. 9 is a perspective view of a room incorporating a lighting system according to an embodiment.

FIG. 9 depicts a perspective view of a room 900 incorporating a lighting system according to an embodiment. Room 900 comprises a set of light sources 901-904 constructed to appear as individual windows, e.g., similar in style to light window 700 (FIG. 7). Light sources 901-904 are cooperatively coupled with a light source controller 905 similar to controller 210 (FIG. 2). In at least some embodiments, light source controller 905 is identical to controller 210 and comprises a wired and/or wireless interface for communicating with light sources 901-904. Controller 905 is cooperatively coupled, e.g., via wired and/or wireless connection, with a switch/control 906 similar to switch/control 204 (FIG. 2). In at least some embodiments, switch/control 906 is identical to switch/control 204. In accordance with the FIG. 9 embodiment, a user in room 900 is able to adjust the spectrum output from light sources 901-904 via manipulation of switch/control 906 as is described above.

In at least some embodiments, controller 905 is electrically connected with a power supply such as a mains or line power supply. In at least some embodiments, light sources 901-904 are electrically connected with the power supply. In at least some embodiments, light sources 901-904 are electrically connected with controller 905 in order to receive power.

In at least some embodiments, light sources 901-904 each comprise an integrated individual light source controller and the individual light source controllers communicate, e.g., either wired and/or wirelessly, with each other and with switch/control 906 in order to control the spectrum output into room 900.

In at least some embodiments, light sources 901-904 may be positioned on different surfaces than those depicted. In at least some embodiments, light sources 901-904 may comprise different sizes and/or shapes. In at least some embodiments, light sources 901-904 may be used in addition to existing light sources unconnected with light sources 901-904 and/or light source controller 905. For example, light sources 901-904 may be used in addition to wall sconces or ceiling fixtures.

Figure 10:
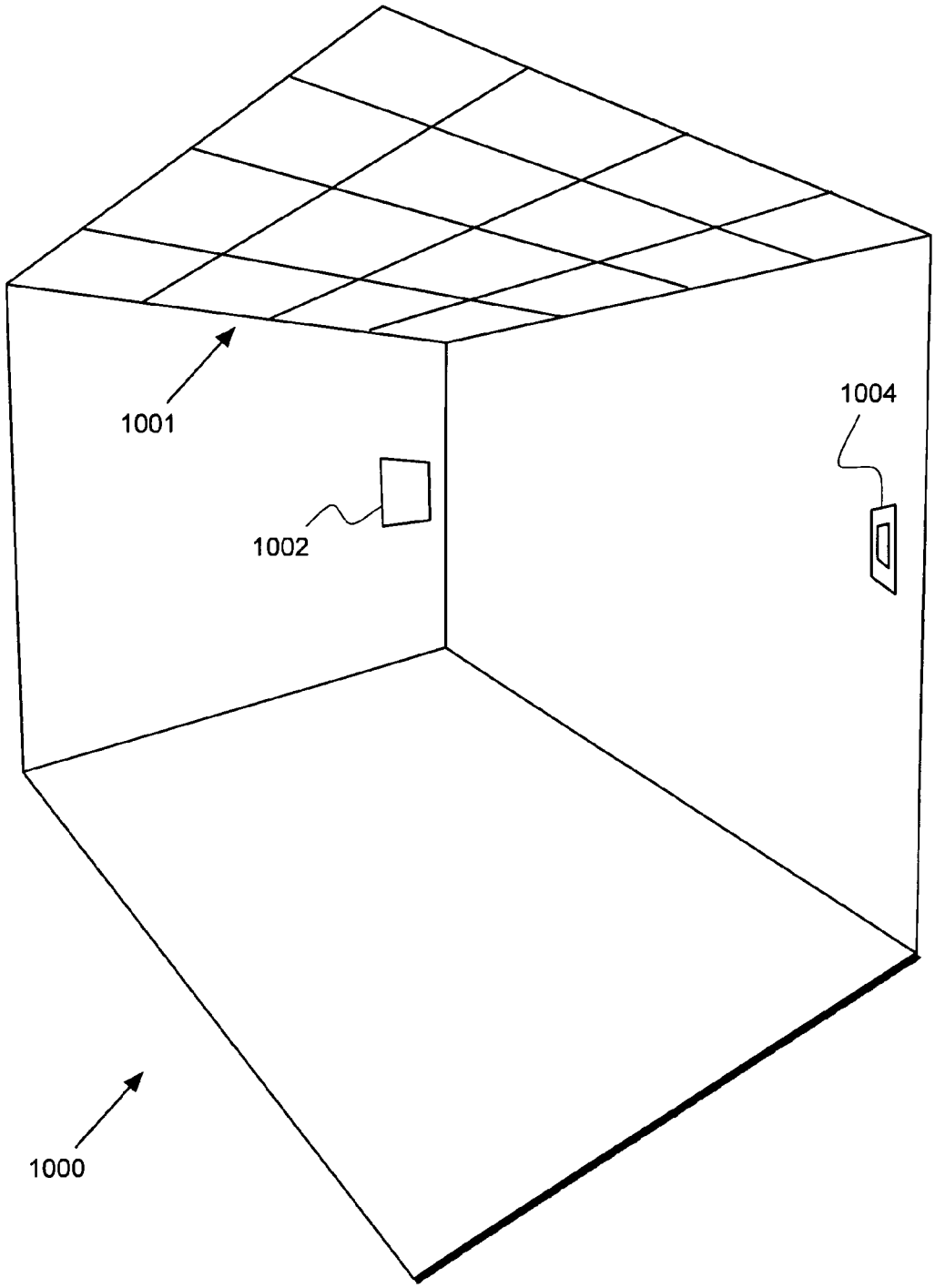
FIG. 10 is a perspective view of a room incorporating a lighting system according to another embodiment.

FIG. 10 depicts a perspective view of a room 1000 incorporating a lighting system according to another embodiment in which the room comprises a set of light sources 1001 configured as ceiling tiles. Similar to the lighting system described above with respect to room 900, the lighting system of room 1000 comprises a controller 1002 and a switch/control 1004 as described with respect to controller 905 and switch/control 906.

In at least some embodiments, light sources 1001 may be positioned on different surfaces than those depicted. In at least some embodiments, light sources 1001 may comprise different sizes and/or shapes. In at least some embodiments, light sources 1001 may be used in addition to existing light sources unconnected with light sources 1001 and/or light source controller 1002. For example, light sources 1001 may be used in addition to wall sconces or other ceiling light fixtures.

What is claimed is:

1. A method of controlling spectral output of a lamp-comprising light sources selected from the group consisting of a fluorescent light source and an LED light source, the light sources including at least one light-generating mechanism which differs from at least one other light-generating mechanism, the method comprising:

specifying a first spectral output frequency greater than zero for a first geographic location and specifying a second spectral output frequency greater than zero for a second geographic location;

determining a geographic location of the lamp;

comparing the geographic location of the lamp to at least the first geographic location or the second geographic location;

determining a desired spectral output frequency based on the comparison of the geographic location of the lamp to at least the first geographic location or the second geographic location; and controlling the spectral output of the lamp based on a user preference, the user preference assigning a priority of control between the determined desired spectral output frequency, a switch position of the lamp, and a determined calendar setting.

2. The method as claimed in claim 1, further comprising detecting a frequency of illumination generated by a light source among the light sources.

3. The method as claimed in claim 1, further comprising monitoring the spectral output of each of the light sources.

4. The method as claimed in claim 1, wherein the controlling comprises applying a percentage allocation of each of the light sources while varying illumination intensity of the light sources at a constant level.

5. A non-transitory computer-readable medium storing instructions which, when executed by a processor, cause the processor to:

determine a geographic location of the lamp comprising light sources selected from the group consisting of a fluorescent light source and an LED light source, the light sources including at least one light-generating mechanism which differs from at least one other light-generating mechanism;

compare the geographic location of the lamp to at least a first stored geographic location or a second stored geographic location;

determine a desired spectral output frequency greater than zero based on the comparison of the geographic location of the lamp to at least the first geographic location or the second geographic location; and control the spectral output of the light sources based on a user preference, the user preference assigning a priority of control between the determined desired spectral output frequency, a switch position of the lamp, and a determined calendar setting.

6. The medium as claimed in claim 5, wherein the control step comprises applying a percentage allocation of each of the light sources while varying illumination intensity of the light sources at a constant level.

7. A fluorescent or light emitting diode-based system for generating light flux comprising:

a lamp comprising:

a plurality of light sources for illuminating an area, the light sources including a plurality of light-generating mechanisms at least one of which is different from the remainder, at least one of the light-generating mechanisms comprising at least one of a fluorescent light source or an LED light source; and a light source controller electrically coupled with the light sources and arranged to control the spectral output of the light sources, the light source controller being arranged to apply a percentage allocation of each of the light sources while varying illumination intensity of the light sources at a constant level;

a power supply;

a switch electrically coupled between the lamp and the power supply and arranged to control the supply of power from the power supply to the lamp; and a position determination system configured to determine a geographic location of the system, specify a first spectral output frequency greater than zero for a first geographic location and specify a second spectral output frequency greater than zero for a second geographic location, compare the geographic location of the system to at least the first geographic location or the second geographic location; determine a desired spectral output frequency based on the comparison of the geographic location of the system to at least the first geographic location or the second geographic location; and the light source controller configured to determine the spectral output of the light sources based on a user preference, the user preference assigning a priority of control between the determined spectral output frequency, a switch position of the lamp, and a determined calendar setting.

* * * * *